United States Patent [19]

Pullinen

[11] Patent Number: 4,757,782

[45] Date of Patent: Jul. 19, 1988

[54] APPARATUS FOR COATING A WEB

[75] Inventor: Martti Pullinen, Jyväskylä , Finland

[73] Assignee: Valmet Oy, Finland

[21] Appl. No.: 892,838

[22] Filed: Aug. 4, 1986

[30] Foreign Application Priority Data

Aug. 7, 1985 [FI] Finland ..... 853041

[51] Int. Cl.[4] ..... B05C 5/02

[52] U.S. Cl. ..... 118/411; 118/410; 118/414

[58] Field of Search ..... 118/414, 410, 413, 411, 118/419; 427/356

[56] References Cited

U.S. PATENT DOCUMENTS

| | | | |
|---|---|---|---|
| 2,729,192 | 1/1956 | Warner | 118/414 X |
| 3,855,927 | 12/1974 | Simeth | 118/261 X |
| 4,063,531 | 12/1977 | Zitzow | 118/411 X |
| 4,245,582 | 1/1981 | Alheid et al. | 118/119 |
| 4,405,661 | 9/1983 | Alheid | 118/413 X |
| 4,465,015 | 8/1984 | Osta et al. | 118/414 X |
| 4,558,658 | 12/1985 | Sommer et al. | 118/413 X |

FOREIGN PATENT DOCUMENTS

| | | | |
|---|---|---|---|
| 1964908 | 8/1970 | Fed. Rep. of Germany | 118/414 |

*Primary Examiner*—John P. McIntosh
*Attorney, Agent, or Firm*—Steinberg & Raskin

[57] ABSTRACT

Apparatus for coating a web, such as paper or board web, comprises a coating nip formed between a rotating counter roll and a smoothing member, or between two smoothing members, through which the web to be coated is passed with a coating substance being applied to the web before it passes through the nip. The apparatus comprises an arrangement by which the linear load and/or the distribution of the linear load in the coating nip is adjustable to control the quantity and/or the distribution of the quantity of the coating substance applied to the web in the transverse direction thereof. A smoothing member comprises an elongate member extending transversely to the direction of web movement through the apparatus and is flexible with respect to its longitudinal dimension so that the profile of the load distribution in the nip can be adjusted to be relatively steep, i.e, the load in the nip may differ relatively widely at points which are relatively close to each other. An arrangement is provided for selectively variably adjusting the load applied to the smoothing member along its longitudinal dimension.

8 Claims, 12 Drawing Sheets

APPARATUS FOR COATING A WEB

BACKGROUND OF THE INVENTION

The present invention relates generally to apparatus for coating a web material, such as paper or board web, and more particularly, to apparatus for coating a web including a coating nip formed between a rotating counter roll and a smoothing or coating member or between a pair of smoothing members, through which nip the web to be coated is passed with a coating substance being applied to the web prior to passing through the nip.

Prior art relevant to the present invention includes CA Patent Nos. 563,750, 689,123, and 1,184,758, FI Patent Application No. 83 3464, and SE Patent Nos. 8205805 and 8205807. Reference is also made to a paper published in paper 201 (1984) wherein a "Short-Dwell Coater" (a trademark of Beloit Corporation) is described.

Various arrangements are known for coating one or both sides of webs, such as paper webs. For example, roll coating devices, blade coating devices and blade-rod coating devices are known for single sided and two-sided coating of paper webs.

In conventional roll coating devices, the web passes through one or more coating nips formed by two opposed rolls with one or more pools of size or coating substance being formed in connection with the nip or nips. In blade coating devices, a counter roll and a coating blade or, alternatively, a pair of blade devices, form the coating nip. In a blade-rod coating device, a counter roll and a blade rod form the coating nip in connection with which the coating substance is applied to the web.

The running speeds of web coating devices have increased in recent years. Speeds as high as 1500 to 1800 m/min are reached during the web coating operation. Moreover, as the widths of paper webs have increased, the precision and durability requirements imposed on the coating devices, i.e., on the coating blades or blade-rods of the coating devices, have become even more exacting.

In this connection, a problem has arisen in the operation of conventional coating arrangements in that coating blades become worn quite rapidly, e.g., requiring replacement after operating for only about 8 to 24 hours. On the other hand, blade coating devices are advantageous in that the transverse distribution of the quantity of coating substance applied to the web can be adjusted quite precisely since the blade is sufficiently flexible in the direction transverse to the direction of movement of the web, that is, in the width dimension of the web.

On the other hand, the rods in blade-rod coating devices are worn less rapidly than blades, requiring replacement only after one to two weeks of operation which is considered satisfactory. However, a drawback of coating arrangements using coating rods is that it is generally not possible to adjust the distribution of the coating substance on the web with the precision desired since the coating rod mounted in its support is so rigid that it will not yield to a sufficient extent in order, for example, to accommodate variations in thickness of the web to be coated.

SUMMARY OF THE INVENTION

Accordingly, one object of the present invention is to provide new and improved apparatus for coating a web.

Another object of the present invention is to provide new and improved web coating apparatus comprising a further development of conventional blade and blade-rod coating apparatus and to provide further developments of devices corresponding to the coating blades and blade-rods.

A further object of the present invention is to provide new and improved web coating apparatus wherein the transverse distribution of the quantity of coating substance and/or the distribution of the coating substance on the web can be controlled and adjusted in a manner which is at least substantially as good as the control and adjustability available in conventional blade coating devices.

A still further object of the present invention is to provide new and improved web coating apparatus which provide good control and adjustability of the transverse distribution of the coating substance on the web and wherein the wear resistance of the coating devices is of the same order as that of the blade-rod coating devices.

Briefly, in accordance with the present invention, these and other objects are attained by providing web coating apparatus comprising a coating nip including at least one elongate smoothing or coating member which is sufficiently flexible with respect to its longitudinal dimension that a desired linear load profile or distribution in the coating nip can be obtained and wherein means are provided for selectively variably adjusting a load applied to the smoothing member along its longitudinal dimension.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
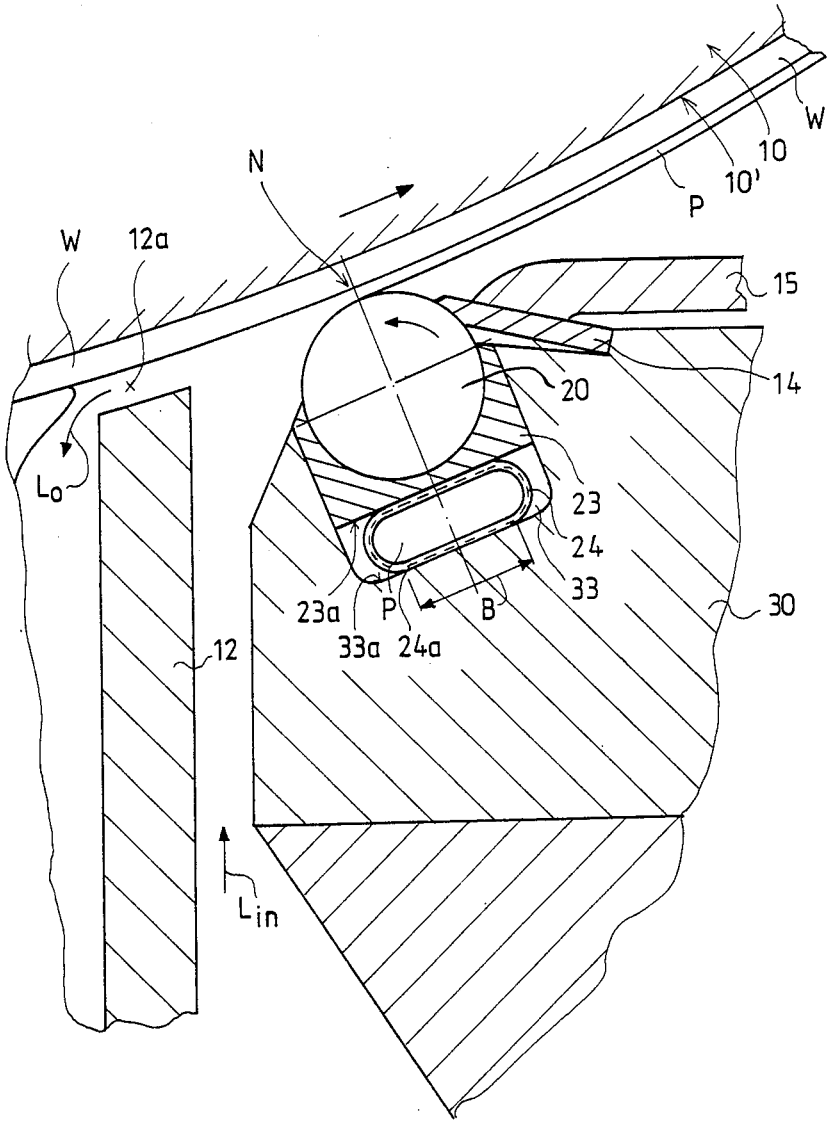
FIG. 1 is a front elevation view in section schematically illustrating a first embodiment of rod coating apparatus in accordance with the invention.
Figure 3:
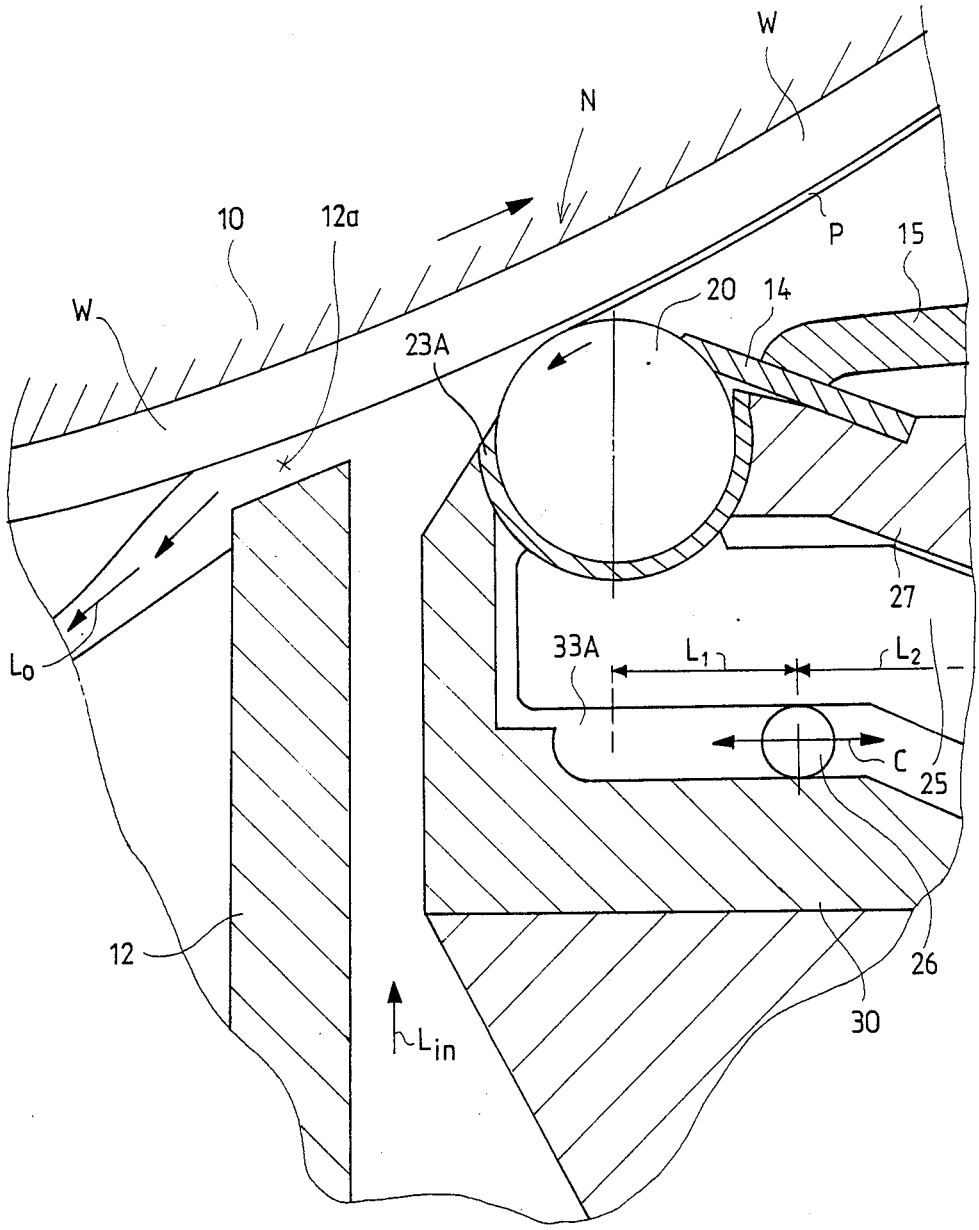
FIG. 3 is a front elevation view in section schematically illustrating a modification of the first embodiment of the rod coating apparatus illustrated in FIG. 1.

Referring now to the drawings wherein like reference characters designate identical or corresponding parts throughout the several views, and more particularly to the embodiments of the rod coating apparatus illustrated in FIGS. 1 and 3, the web coating apparatus comprises a rotating counter roll 10 having a smooth cylindrical surface 10' over which the web to be coated, e.g. paper web W, is passed. A coating or smoothing rod 20, which may be either solid cylindrical or tubular, forms a coating nip N with the surface 10' of counter roll 10 through which the web to be coated runs.

In accordance with the invention, the rod 20 is supported by a special arrangement provided in frame 30 of the apparatus. The coating rod 20 comprises an elongate member having a longitudinal dimension extending transversely to the direction of movement of web W and in accordance with the invention is substantially as flexible and pliable as conventional coating blades so that the distribution of the coating substance in the transverse or width dimension of the web can be adjusted sufficiently precisely and steeply that a layer of coating substance will have a substantially uniform thickness regardless of variations in the thickness of the web. The exact flexibility of the coating rod 20 depends on the desired width of the coating to be applied. The rod 20 may have a diameter in the range of between about 10 mm to 15 mm. The counter roll may have a diameter of about 1000 mm.

Figure 2:
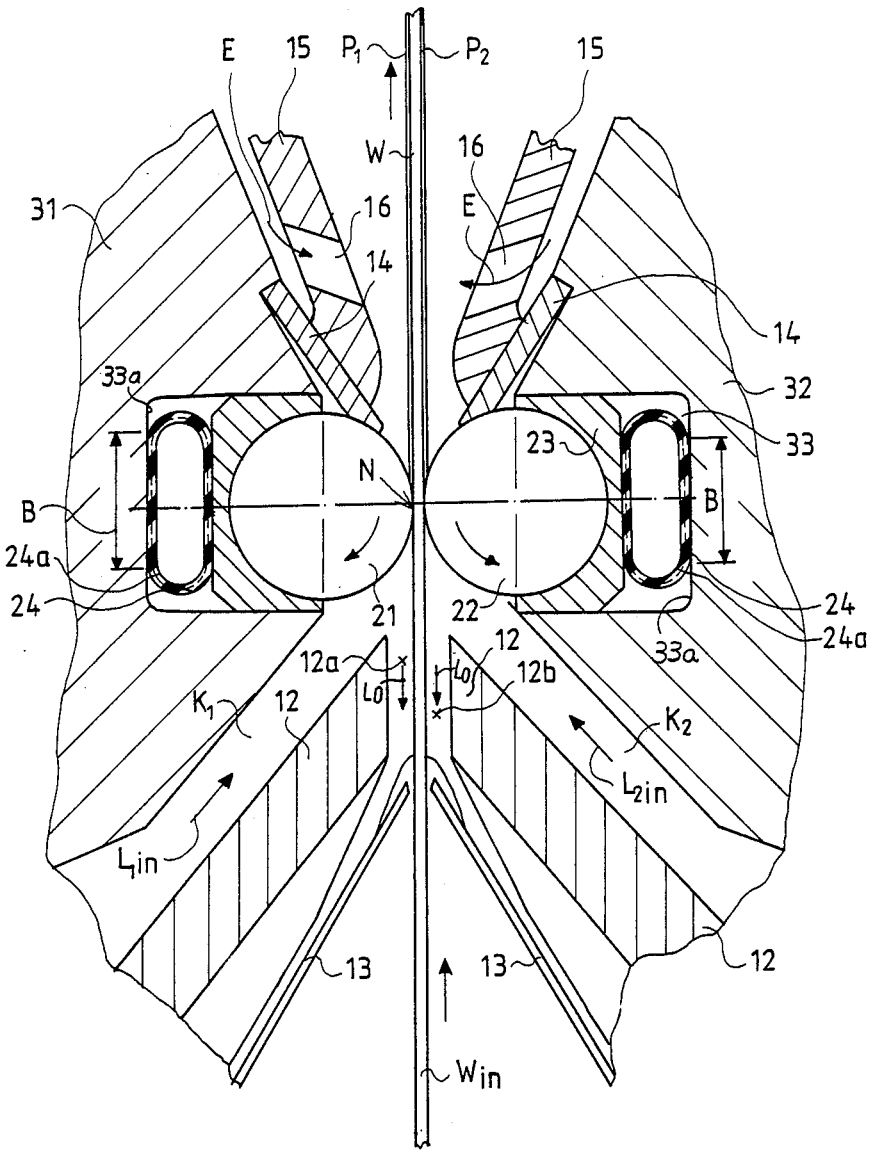
FIG. 2 is a front elevation view in section schematically illustrating a second embodiment of rod coating apparatus in accordance with the invention, the coating nip being formed between two coating rods situated in opposed relationship with respect with each other.

The coating substance, such as coating size is applied onto the web W prior to the web passing through the nip N by introducing the coating substance in the direction of arrows $L_{in}$ whereupon any excess coating substance is passed through a gap 12*a* formed between blades 12 in the direction of arrows $L_o$. By adjusting the magnitude of the gaps 12*a*, the pressure of the coating substance effective on the web W prior to nip N and within the area of the nip can be adjusted. In accordance with the embodiment of FIG. 2, discussed below, the coating substance is introduced through the ducts $K_1$ and $K_2$ in the direction of arrows $L_1$ in and $L_2$ in to the upstream side of the nip N whereupon any excess coating substance is passed through the gaps 12*a* and 12*b* formed betweeen the blades 12 in the web $W_{in}$ in the direction of arrows $L_0$, guided by additional blades 13. Again, by adjusting the magnitude of the gaps 12*a* and 12*b*, it is possible to adjust the pressure of the coating substance which is effective in the nip. In the embodiment of FIG. 2, both sides of the web W are coated with coating layers $P_1$ and $P_2$ respectively as the web is passed through nip. After passing through the nip, hot air is directed onto the coating layers $P_1$ and $P_2$ in the direction of arrows E through openings 16 formed in blades 14 in order to dry the coating layers.

Referring to the embodiment of FIG. 1, the coating rod 20 is supported on a counterpiece 23 through engagement with a semi-circular counter-surface thereof. The counterpiece 23 comprises an elongate member which is sufficiently flexible with respect to its longitudinal dimension so as to conform with the flexing of the coating rod 20 to achieve the desired linear load distribution in the nip N. The counterpiece 23 is mounted in a groove 33 formed in frame part 30 and has a planar outer surface 23*a* which is engaged by an outer surface region of a loading hose 24. An opposed surface region of the hose 24 bears against the bottom surface 33*a* of groove 33. It is preferable that the loading hose 24 be constructed so that its wall is non-extensible so that the length of its circumference is maintained constant regardless of the internal pressure within the hose. For example, a mesh 24*a* may be embedded within the thickness of the hose 24.

A linear load of desired magnitude is applied in the coating nip N by applying a suitable load to the coating rod 20 along its longitudinal dimension through the selective control of the internal pressure P within the loading hose 24. In order to selectively variably adjust the load applied to the coating rod along its longitudinal dimension to adjust the transverse profile of the quantity of coating substance applied to the web, the bottom surface 33*a* of groove 33 is composed of a plurality of separate members, each of which can be displaced towards and away from the bearing surface 23*a* of counterpiece 23 separately from the other parts in order to compress opposed regions of the loading hose 24. In this manner, the degree of flatness of the hose can be varied thereby adjusting the length, designated B, of the surface area of surface 23*a* of counterpiece 23 on which the hose 24 bears and through which the pressure P is transmitted to thereby obtain a desired variation in the distribution of the linear load applied to the coating rod 20. The loading force thereby applied is proportional to the product $P \times B \times L$, where L is the length of hose portion loaded.

In the embodiment of FIG. 2, a pair of opposed flexible blade rods 21 and 22 form the coating nip N. The rods are supported by respective counterpieces 23 in respective grooves 33 provided in the frame parts 31 and 32. The counterpieces 23 are loaded by hoses 24 in the same manner as described above in connection with FIG. 1 so that an adjustable distribution of the linear load in the nip N is obtained for the purpose of adjusting one profile of the quantity of the coating substance applied to the web.

Figure 4:
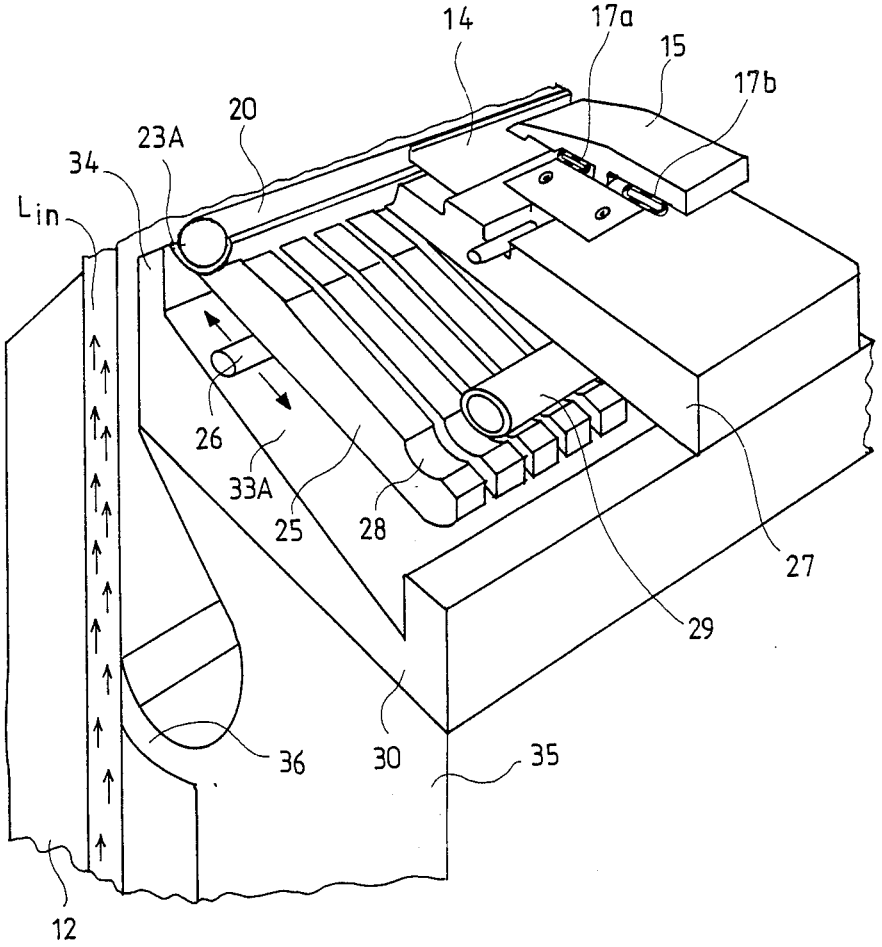
FIG. 4 is an axonometric view, partially broken away, of the rod coating apparatus illustrated in FIG. 3.

Referring to FIGS. 3 and 4, an embodiment of rod coating apparatus in accordance with the invention is illustrated by means of which the transverse loading profile applied to the rod 20 can be precisely controlled. The coating rod 20 is supported by a flexible intermediate or counterpiece 23A mounted in the frame part 30. The flexible counterpiece 23A is engaged along its longitudinal dimension by the ends of a plurality of loading levers 25 which are situated in side-by-side relationship in a direction transverse to the direction of web movement through the apparatus. As seen in FIG. 4, the surface regions 28 at the other ends of levers 25 are engaged by a loading hose 29 which is captured in position by a frame part 27 to which a support member 15 for a doctor blade 14 is attached. The support part 15 for doctor blade 14 may be provided with its own loading hoses 17*a* and 17*b* (FIG. 4) by means of which it is possible to adjust the force applied by the doctor blade 14 against coating rod 20.

The distribution of the linear load in the nip N in the embodiment of FIGS. 3 and 4 in the direction of the longitudinal dimension of rod 20 is controlled by suitably adjusting the lever ratio $L_1/L_2$ of each of the levers 25. This is accomplished by shifting fulcrums 26 of levers 25 in the directions of arrow C (FIG. 3). Each lever 25 is therefore preferably provided with its own fulcrum 26 which rests on the bottom 33A of groove 33. In this manner, a constant loading force produced by the loading hose 29 is translated into a loading force on coating rod 20 which is selectively variable in the direction of the longitudinal dimension of rod 20. Of course, suitable devices (not shown) are provided for shifting the respective fulcrums 26.

Figure 5:
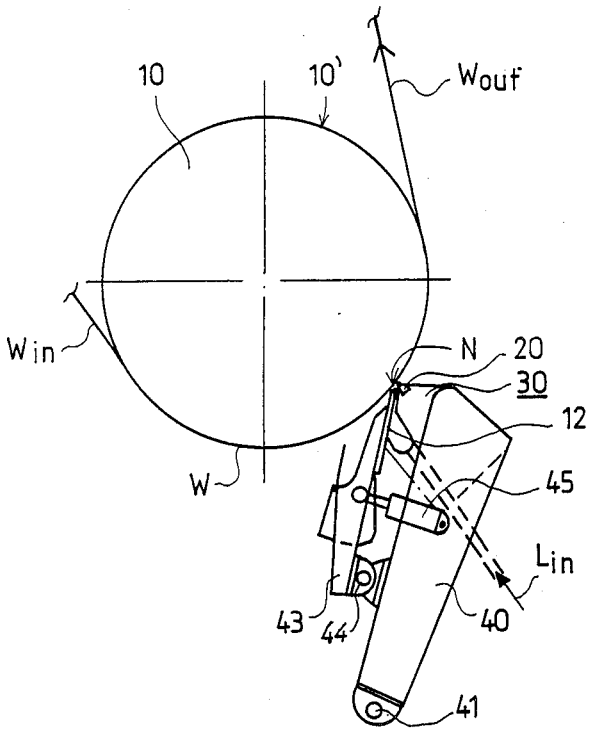
FIG. 5 is a front elevation view schematically illustrating supporting and loading arrangements of a coating or smoothing member.

Referring now to FIG. 5, an arrangement by which the coating rod 20 is mounted for coating the web W running over roll 10 is illustrated. The frame part 30 in which the coating rod 20 (or other coating member of the type described below) is attached to a beam 40 which extends over the entire width of the web. The beam 40 is attached to the frame part of the coating apparatus by means of horizontal articulated joints 41 so that it can be pivoted, and possibly loaded, against roll 10 by conventional power units. The blade 12 is attached to a frame part 43 which is also connected to frame beam 40 by means of horizontal articulated joints 44. The position of the frame part 43 can be adjusted by actuating means 45 to control the size of the gap 12*a* (FIG. 1) to thereby control the pressure that prevails in the coating substance in front of nip N. It will be understood that the particular frame arrangement illustrated in FIG. 5 is described only by way of example so as to provide an understanding of the construction of the apparatus in its entirety.

Figure 6:
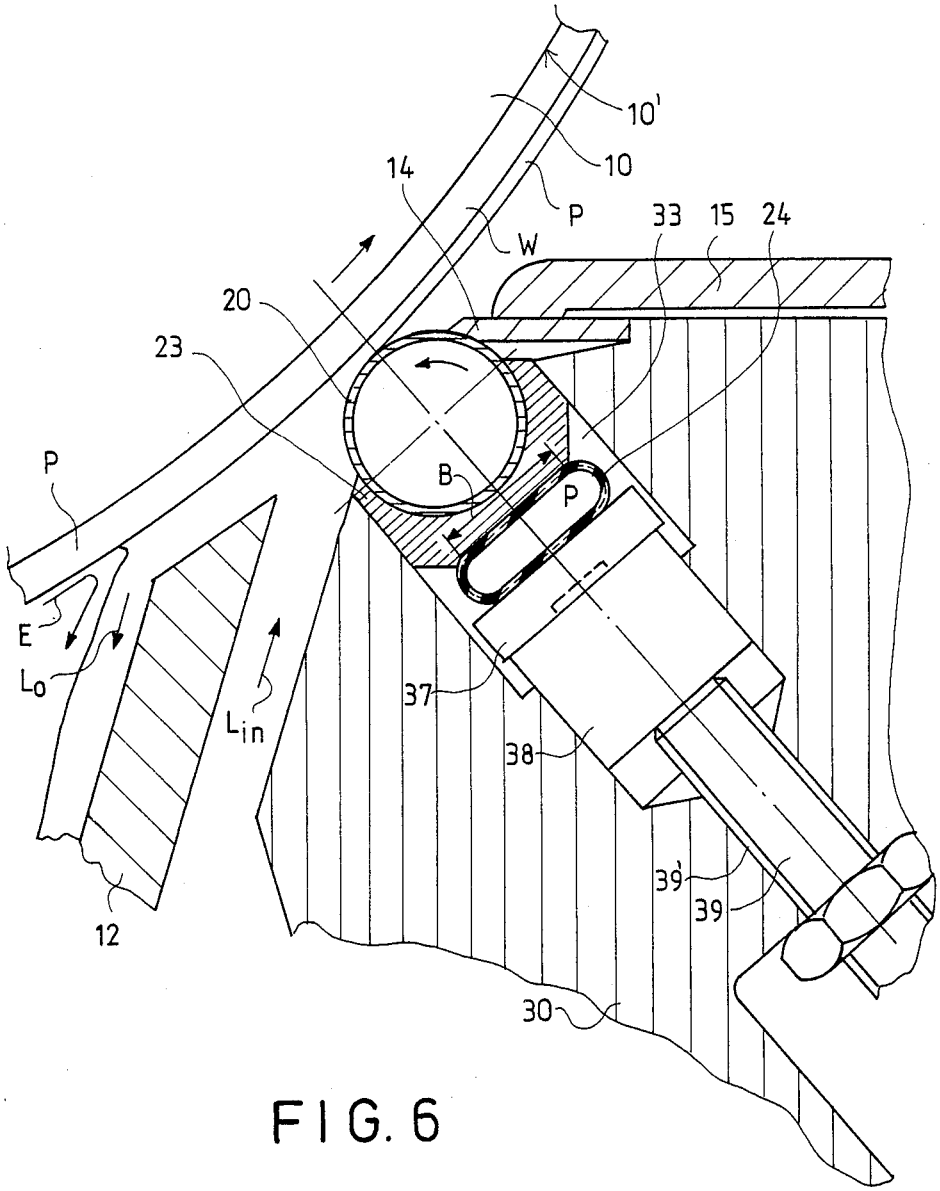
FIG. 6 is a front elevation view in section schematically illustrating an embodiment of rod coating apparatus which operates in accordance with the principles of operation of the embodiments illustrated in FIGS. 1 and 3.
Figure 7:
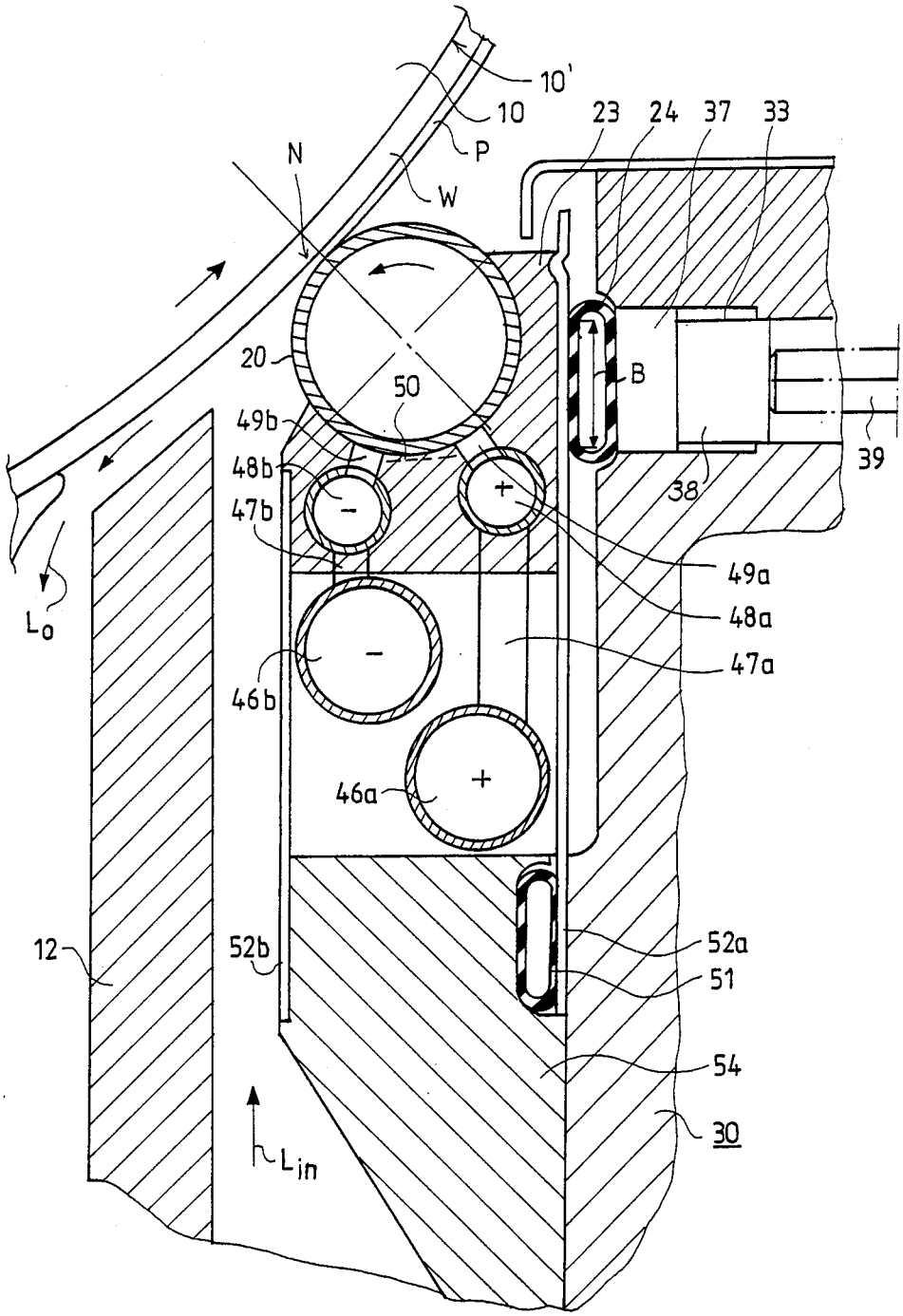
FIG. 7 is a front elevation view in section schematically illustrating an embodiment of rod coating apparatus in accordance with the invention and which is provided with an arrangement for washing the coating rod.

Referring to FIGS. 6 and 7, embodiments of rod coating apparatus in accordance with the invention are illustrated wherein the means for selectively variably adjusting the load applied to the coating rod along its longitudinal dimension are illustrated in detail. An elongate unitary flexible intermediate part 37 is situated in the lower part of groove 33 extending in the direction of the longitudinal dimension of the coating rod 20. The outer surface of the flexible intermediate member 37 bears against a surface of the loading hose 24. A plurality of pusher elements 38 are situated in side-by-side reltionship with an upper surface of each bearing against an opposed surface region of intermediate member 37. The pusher elements 38 are slidable within extensions of the groove 33. Each of the pusher elements 38 is associated with a respective adjusting screw 39 received in threaded bores 39′ formed in frame part 30. It will be seen that through the adjustment of the screws 39, it is possible to adjust the length B of the surface counterpiece 23 against which loading hose 24 bears. Accordingly, it is possible to adjust the distribution of the loading force and, consequently, the distribution of the quantity of the coating substance applied to the web, such distribution being affected to some extent by the spacing of the screws 39 and by the flexibility of the contact rod 20, counterpiece 23 and intermediate member 37.

Referring to FIG. 7, an embodiment of rod coating apparatus in accordance with the invention is illustrated wherein provision is made for washing the coating rod 20 as it rotates in the counterpiece 23. The washing means include an inlet pipe 46*a* formed in frame part 54 through which wash water is provided. Several distribution pipes 47*a* communicate with inlet pipe 46*a*, the distribution pipes supplying wash water from inlet pipe 46*a* into a pipe 48*a* embedded in counterpiece 23. Passages 49*a* communciate with pipe 48*a* and open into grooves 50 formed in counterpiece 23. The grooves 50 have a suitable pitch with respect to the direction of rotation of the rod 20 so that the wash water passing throught the grooves 50 flush and wash the entire outer surface of the rod 20. The wash water is passed from the grooves 50 back through passages 49*b* into a pipe 48*b* embedded in the counterpiece 23 and from there through a distribution pipe 47*b* into a water discharge pipe 46*b*.

Still referring to FIG. 7, the counterpiece 23 of coating rod 20 is supported by flexible plates 52*a* and 52*b* between the frame part 30 and the projecting part 54. A pressure hose 51 may be used to provide a resilient fastening of the part 52*a* between parts 30 and 54. Such mounting also enables a slight shifting of the part 52*a* in the direction of its plane both upwardly and downwardly when the counterpiece 23 is loaded by loading hose 24 and when the distribution of the loading force in the direction of the longitudinal dimension of coating rod 20 is being set by adjusting screws 39 in the manner described above.

Figure 8:
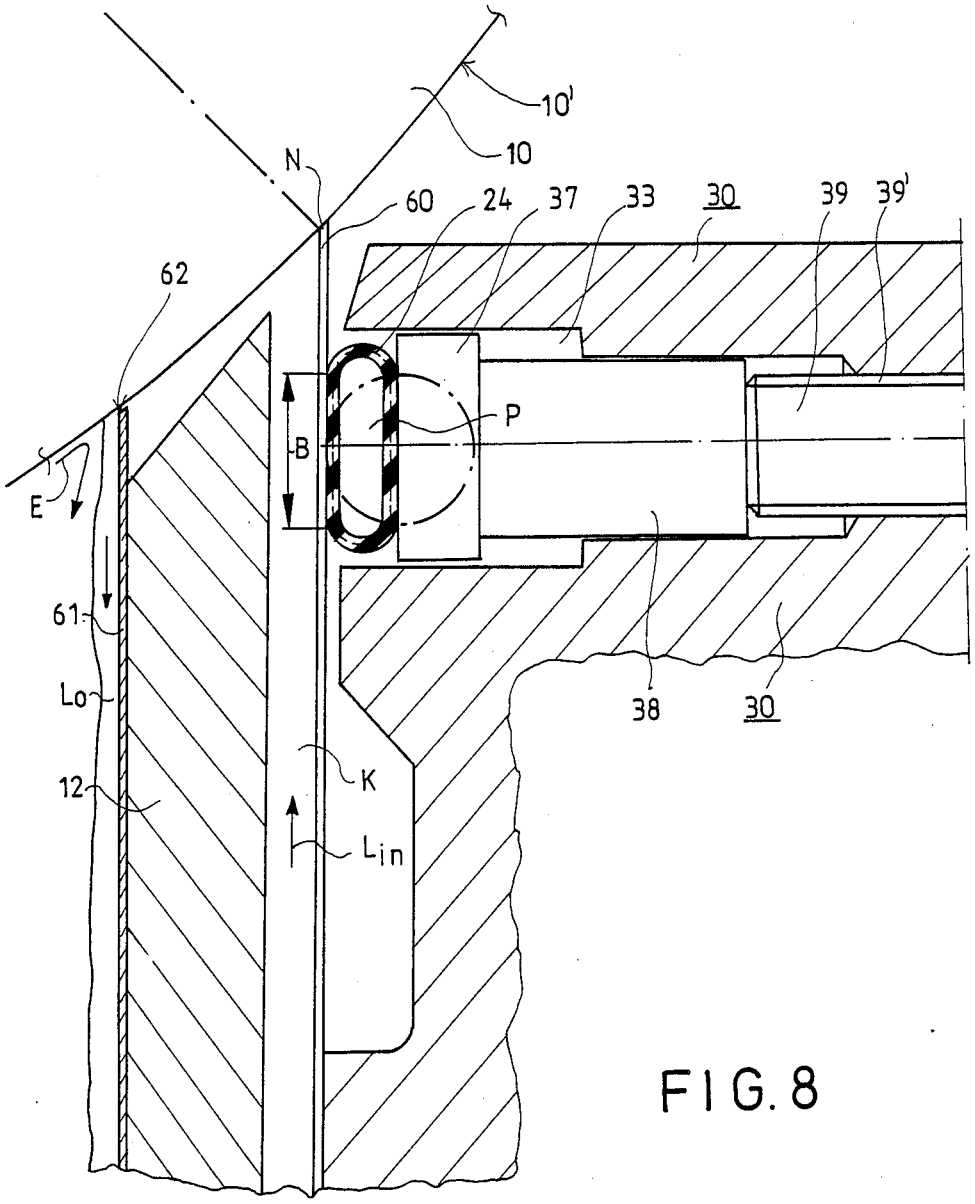
FIG. 8 is a front elevation view in section schematically illustrating an embodiment of blade coating apparatus in accordance with the invention.

Referring now to FIG. 8, an embodiment of blade coating apparatus in accordance with the invention is illustrated including a coating blade 60 forming a coating nip N with the surface 10′ of counter roll 10. The coating blade 60 is loaded against the counter roll 10 by means of a loading hose 24 directly engaging the same. The loading hose is itself loaded by means of a unitary intermediate member 37, a plurality of pusher elements 38 situated in a manner as described above in connection with FIG. 6, and respective adjusting screws 39. The size or other coating substance is supplied to the duct K in the direction of arrow $L_{in}$ to the upstream side of the blade 60. A blade 61 mounted on a blade 12 forms a gap 62 with counter roll 10 that restricts the overflow $L_0$ of the size thereby determining the pressure prevailing in the size upstream of nip N.

Figure 9:
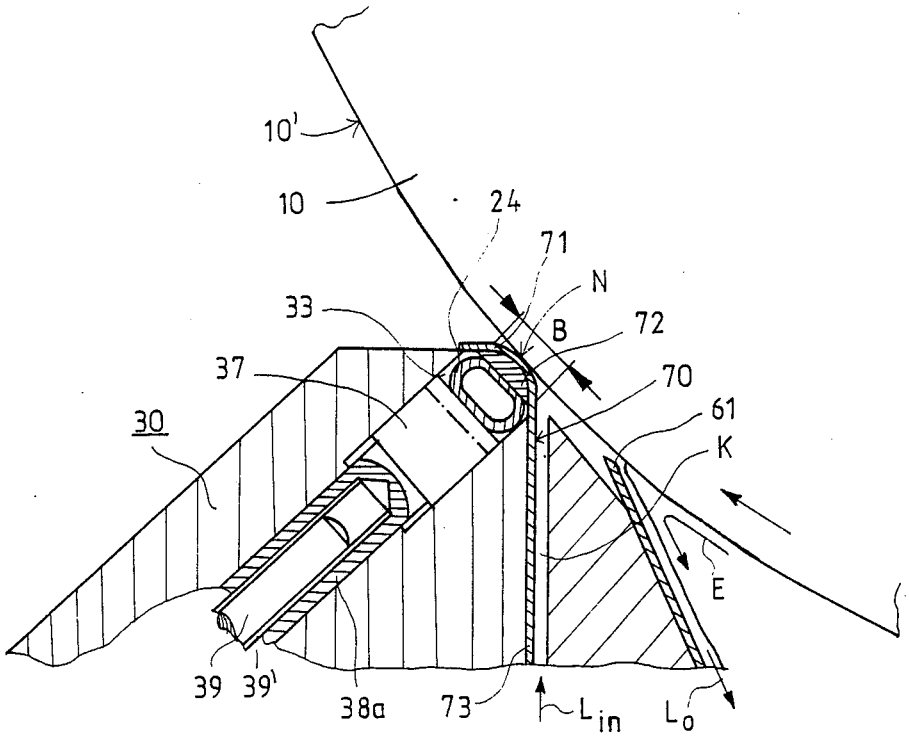
FIG. 9 is a front elevation view in section schematically illustrating an embodiment of coating apparatus utilizing a smoothing or coating member of shaped cross-section having a convexly curved face situated in opposed relationship to a counter roll.

Referring to FIG. 9, an embodiment of coating apparatus in accordance with the invention wherein the coating member comprises a member 70 for smoothing the coating is illustrated. The smoothing member 70 comprises an elongate member having an outer part which is curved, i.e., has a convex cross-section in a plane perpendicular to its longitudinal dimensions, the outer part 71 forming a smoothing nip with the counter roll 10. The curved outer part 71 preferably has a circular section configuration and a projecting plate-shaped arm portion 73 extends from outer part 71, the smoothing member 70 being connected to the frame part 30 by the projecting part 73.

Figure 10A:
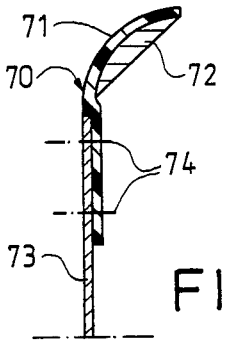
FIGS. 10A–10E illustrate various configurations of smoothing members used in coating apparatus of the type shown in FIGS. 9, 11 and 12, FIG. 10A comprising a section view taken along line A—A of FIG. 10C.
Figure 10B:
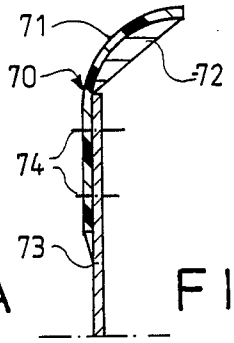
Figure 10C:
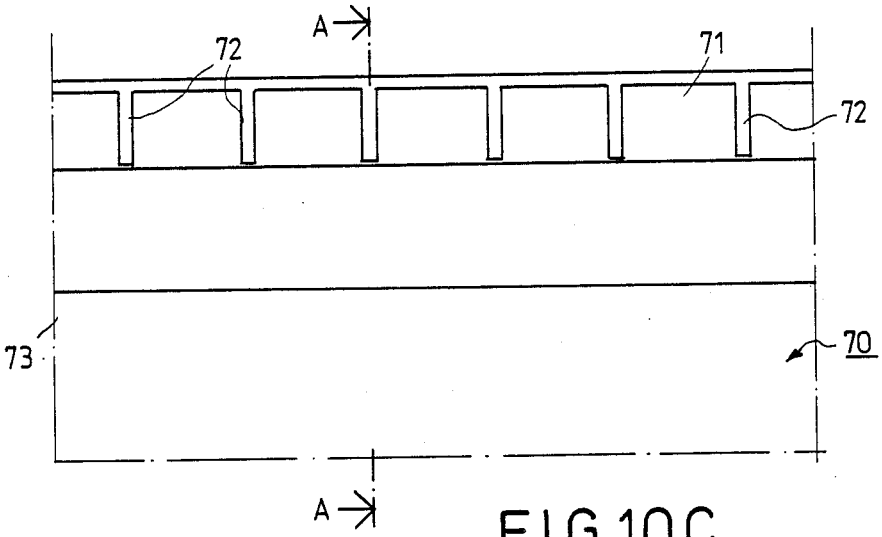
Figure 10D:
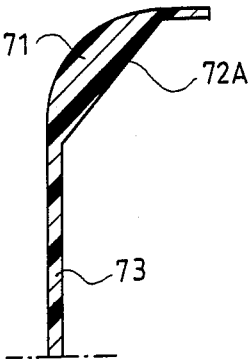
Figure 10E:
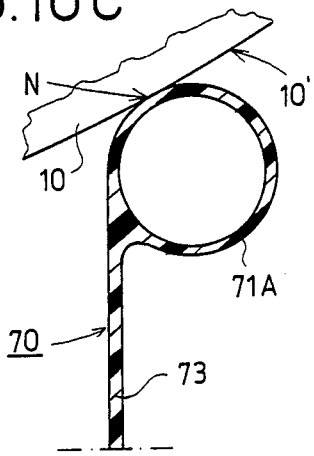

Referring to FIG. 9 in conjunction FIGS. 10A to 10C, reinforcement ribs 72 are provided at the inner sides of the convex outer part 71 and the spaces between the ribs 71 are filled with a suitable mass. In the embodiment of FIGS. 10A and 10C the curved outer part 71 is attached to the plate-shaped projecting portion 73 by means of rivets or screws 74 with the projecting part 73 being attached to the frame part 30 as shown in FIG. 9. As seen in FIG. 9, a duct K is formed in part by projecting part 73 through which size is supplied, designated by arrrow $L_{in}$, to a region upstream of the nip N defined by the counter roll 10 and in the smoothing member 70. In the embodiment of FIG. 10D, a reinforcement part 72A formed of solid material is provided in conjunction with the curved outer part 71. In the embodiment of FIG. 10E, the smoothing member 70 comprises a plate-shape arm or projecting part 73 at the end of which a tubular part 71A is provided which defines the nip N with the counter roll 10.

Figure 11:
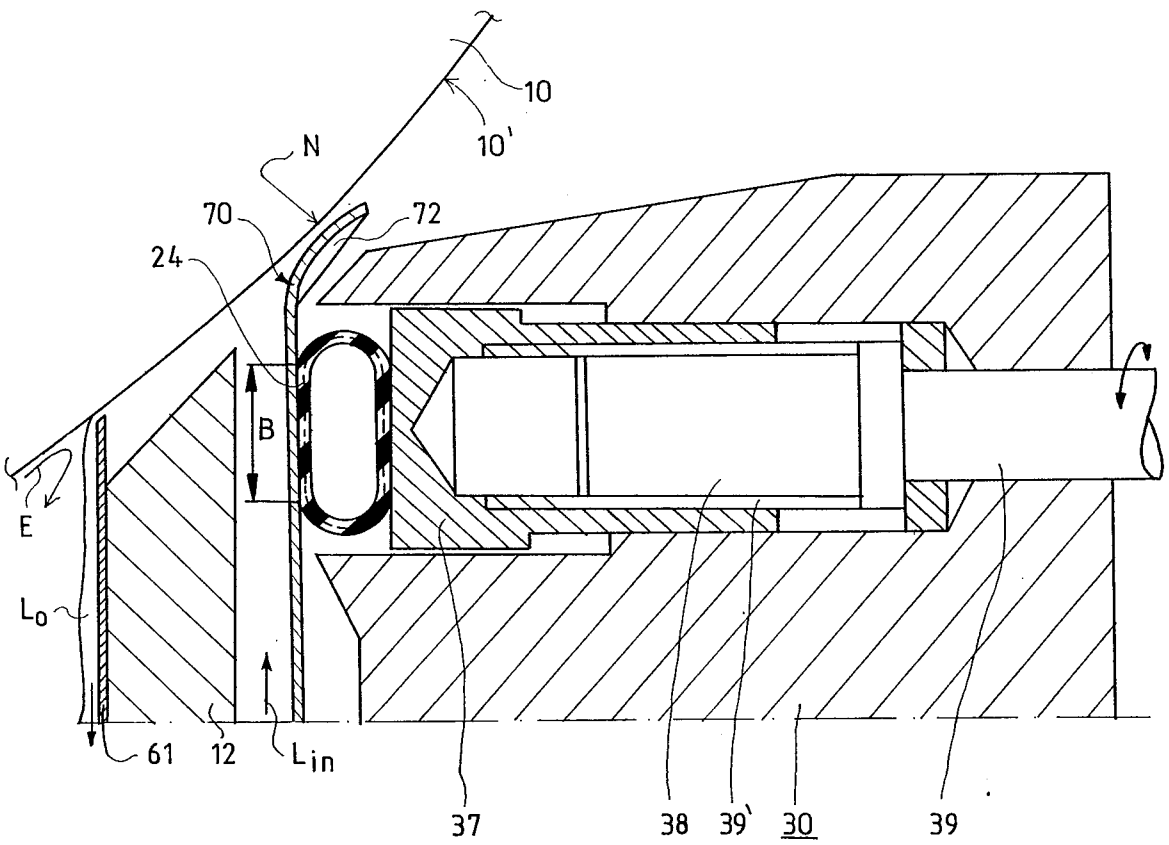
FIG. 11 is a front elevation view in section schematically illustrating a second embodiment of coating apparatus utilizing a smoothing member having shaped cross-section.

Referring to FIG. 11, an arrangement for loading a smoothing member 70 of the type described above so as to provide for a selectively variably adjustable profile of the loading force applied in the nip N in the transverse direction with respect to the direction of web movement is illustrated. The illustrated arrangement is similar to that described above in connection with the blade-coating device of FIG. 8. In particular, the loading hose directly engages the surface region of the smoothing member 70 while a unitary elongate flexible intermediate member 37 bears against the other side of the loading hose 24. A plurality of pusher elements 38 are spaced in side-by-side relationship in the transverse direction and are associated with respective threaded members 39 to apply the selectively variably load to the smoothing member.

Figure 12:
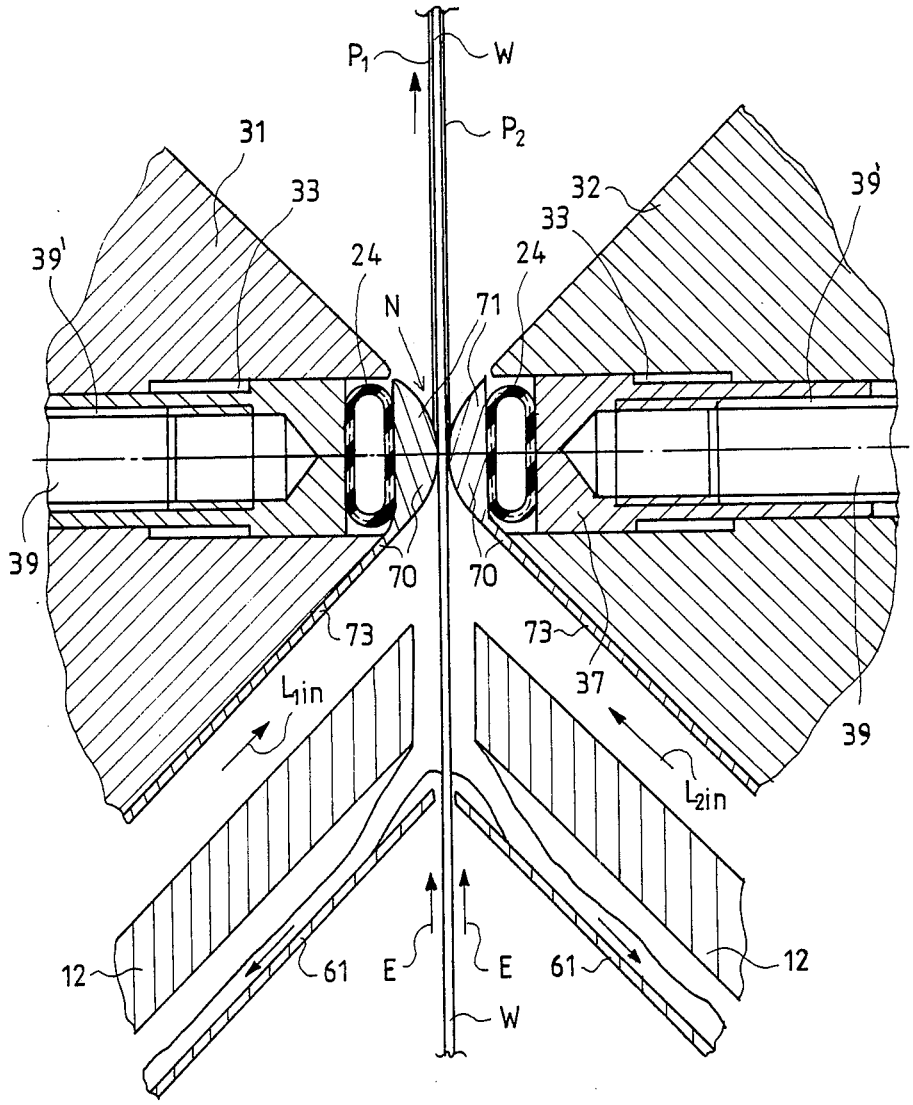
FIG. 12 is a front elevation view in section schematically illustrating an embodiment of coating apparatus in accordance with the invention utilizing a pair of opposed smoothing members having shaped cross-sections.

Referring to FIG. 12, an embodiment of the invention is illustrated in which two smoothing members 70 are situated in opposed relationship to each other to form a nip N between them. The smoothing members used in the apparatus illustrated in FIGS. 9–12 are formed, for example, of polyacetal or equivalent material which can be coated, if necessary, to render the same wear-resistant. For example, the smoothing members may be provided with a ceramic coating prepared by spraying a wear resistant surface layer onto the frame part.

The loading hoses 24 of FIG. 12 bear against the planar portions of the reinforcing means provided on the outer convexly-curved part 71. The device shown in FIG. 12 is in other respects similar to the embodiment shown in FIG. 2 with the distribution of the loading pressure on the smoothing members 70 controlled by means of adjusting screws 39.

An important parameter which affects coating of a web by a blade coater is the so-called blade angle, namely the angle formed between the plane of the coating blade and a plane tangential to the nip. A sufficiently steep adjustment of the profile of the linear load in the coating nip N is advantangeously accomplished by means of devices in accordance with the invention so that the blade angle is not changed to a substantial extent during adjustment of the profile of the linear load even over relatively wide ranges of adjustment.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In apparatus for coating a web of material, such as paper or board web, moving through said apparatus comprising, a frame;

an elongate smoothing member mounted on said frame havng a longitudinal dimension extending transversely to the direction of movement of the web through said apparatus, said smoothing member being flexible in its longitudinal direction;

a counter member situated in opposed relationship to said smoothing member and forming a smoothing nip therebetween through which the web is adapted to pass;

means for applying a coating substance onto the web prior to the web passing through said nip; and means for applying a linear load in said smoothing nip, said nip loading means including means for applying a load to said smoothing member along its longitudinal dimension;

the improvement comprising:

said elongate smoothing member includes an outer part having a substantially convex-shaped cross-section in a plane perpendicular to its longitudinal dimension, said outer part of said smoothing member forming said smoothing nip with said counter member, said elongate smoothing member further including an arm portion projecting from said convex-shaped outer part, and wherein said arm portion is connected to said frame to thereby connect said elongate smoothing member to said frame;

said outer part of said smoothing member forming said smoothing nip is substantially shaped as a segment of a circle and said smoothing member further includes reinforcing means cooperating with said circular segment outer part for reinforcing said outer part, said reinforcing means defining substantially planar bearing surface means; and said means for applying a load to said smoothing member comprise at least one internally pressurizable loading hose means engaging said planar bearing surface means defined by said reinforcing means or engaging an inner surface of said arm portion.

2. The combination of claim 1 wherein said counter member comprises a second elongate flexible smoothing member including an outer part having a substantially convex-shaped cross-section in a plane perpendicular to its longitudinal dimension, said outer parts of said smoothing members forming said smoothing nip between them.

3. The combination of claim 1 wherein said arm portion projecting from said convex-shaped outer part is substantially plate-shaped.

4. The combination of claim 1 further including means cooperating with said smoothing member loading means for selectively variably adjusting the load applied to said smoothing member along its longitudinal dimension.

5. The combination of claim 4 wherein said at least one internally pressurizable loading hose means have a first surface region engaging said smoothing member, and wherein said means for selectively variably adjusting the load applied to said smoothing member comprise means for applying a load to a second surface region of said loading hose means opposite from said first surface region thereof engaging said smoothing member, whereby variations in the load applied to said loading hose means results in a corresponding variation in the area of said first surface region of said hose means engaging said smoothing member, which results in a corresponding variation in the load applied to said smoothing member by said hose means, the internal pressure of said hose means remaining substantially constant.

6. The combination of claim 4 wherein said means for selectively variably adjusting the load applied to said smoothing member include a series of counterpieces engaging said hose means.

7. The combination of claim 6 wherein said loading hose means have a substantially non-extensible circumference whereby the circumference of said loading hose means remains substantially constant regardless of variations in the loading pressure.

8. The combination of claim 6 wherein said means for selectively variably adjusting the load applied to said smoothing member further include a series of separately adjustable threaded members cooperating with respective counterpieces.

* * * * *